United States Patent [19]

Niebylski

[11] 4,266,946

[45] May 12, 1981

[54] GASOLINE CONTAINING EXHAUST EMISSION REDUCING ADDITIVES

[75] Inventor: Leonard M. Niebylski, Birmingham, Mich.

[73] Assignee: Ethyl Corporation, Richmond, Va.

[21] Appl. No.: 144,396

[22] Filed: Apr. 28, 1980

[51] Int. Cl.[3] ..... C10L 1/18; C10L 1/30

[52] U.S. Cl. ..... 44/68; 44/66; 252/386

[58] Field of Search ..... 44/68, 66; 252/386

[56] References Cited

U.S. PATENT DOCUMENTS

| | | | |
|---|---|---|---|
| 3,574,574 | 4/1971 | Moore et al. | 44/66 |
| 4,005,993 | 2/1977 | Niebylski et al. | 44/68 |
| 4,141,693 | 2/1979 | Feldman | 44/68 |
| 4,175,927 | 11/1979 | Niebylski | 44/68 |
| 4,207,078 | 6/1980 | Sweeney et al. | 44/68 |

*Primary Examiner*—Winston A. Douglas
*Assistant Examiner*—J. V. Howard
*Attorney, Agent, or Firm*—Donald L. Johnson; Joseph D. Odenweller; Willard G. Montgomery

[57] ABSTRACT

Exhaust hydrocarbon emissions from an internal combustion engine being operated on gasoline containing a cyclopentadienyl manganese antiknock are reduced by the addition of an exhaust emission reducing amount of a polyester of a polymerized carboxylic acid to the gasoline.

92 Claims, No Drawings

GASOLINE CONTAINING EXHAUST EMISSION REDUCING ADDITIVES

BACKGROUND OF THE INVENTION

This invention relates to motor fuel compositions for a spark ignited internal combustion engine. More specifically, this invention relates to a motor fuel composition for use in an internal combustion engine which results in reduced hydrocarbon emissions in the exhaust gas. In particular, this invention relates to a liquid hydrocarbon fuel of the gasoline boiling range containing, as an antiknock, a cyclopentadienyl manganese compound and, as an exhaust emission reducing additive, a polyester of a polymerized carboxylic acid.

Fuels used in today's automotive engines cause deposits to be formed during combustion. Formation of these deposits in the combustion chambers of the engine can result in increased amounts of unburned or partially oxidized hydorcarbons emitted with the engine exhaust gas. Such unburned hydrocarbons tend to react with other atmospheric substituents to substantially contribute to air pollution. Cyclopentadienyl manganese compounds have proven to be excellent antiknocks in gasolines used to operate internal combustion engines. They have been especially beneficial in solving some of the problems present when low-lead or lead-free gasolines are used with internal combustion engines. Use of such compounds as antiknocks is described in U.S. Pat. Nos. 2,818,417, 2,839,552 and and 3,127,351, all incorporated herein by reference. It is believed, however, by some researchers in the field, that the presence of certain of these organomanganese antiknocks in some of today's low-lead or lead-free gasoline motor fuels tend, in some manner, not altogether fully understood, to promote or increase the amount of unburned and/or partially oxidized hydrocarbons emitted from an engine which is operated on such a fuel. Thus, a need exists for a method to reduce the amount of unburned or partially oxidized hydrocarbons introduced into the atmosphere from the exhaust gas of an internal combustion engine operating on a lead-free or substantially lead-free gasoline containing, as an antiknock, a cyclopentadienyl manganese antiknock compound. In the past, there have been efforts to reduce the amount of exhaust hydrocarbon emissions produced by the consumption of unleaded fuel in automobile engines. For example, U.S. Pat. No. 4,175,927 discloses the addition of a dimer acid and/or a trimer acid produced by the polymerization or condensation of an unsaturated aliphatic monocarboxylic acid having between 16 and 18 carbon atoms to gasoline containing a cyclopentadienyl manganese tricarbonyl antiknock to reduce hydrocarbon emissions in an engine operating on such a fuel. So far as is known, however, no effort has been made to reduce hydrocarbon emissions from an internal combustion engine operating on an unleaded gasoline containing a cyclopentadienyl manganese antiknock by incorporating into the gasoline esters of a polymerized carboxylic acid. U.S. Pat. No. 3,574,574 discloses the addition of fully esterified esters prepared from the dimer and trimer acids produced by the polymerization or condensation of an unsaturated aliphatic monocarboxylic acid having between 16 and 18 carbon atoms per molecule to gasoline containing a tetraalkyl lead compound. Reportedly, the presence of the ester additives in leaded gasoline reduces or eliminates the accumulation of harmful deposits composed of the by-products of fuel combustion and lubricating oil deterioration which forms on the intake valves and around the port areas of the engine operating on the leaded fuel. U.S. Pat. Nos. 2,849,399 and 4,167,486 disclose polymerized carboxylic acid esters as lubricity agents. U.S. Pat. No. 2,673,184 discloses a lubricating grease composition which comprises alcohol esters of dilinoleic acid thickened with a minor amount of lithium.

SUMMARY OF THE INVENTION

It has now been discovered that a minor amount of a polyester of a polymerized carboxylic acid when dissolved in a motor fuel containing a cyclopentadienyl manganese antiknock compound is effective for reducing the exhaust hydrocarbon emissions from an internal combustion engine operating on the motor fuel. More specifically, exhaust hydrocarbon emissions of an internal combustion engine operating on a motor fuel composition which comprises a mixture of hydrocarbons boiling in the gasoline boiling range and a cyclopentadienyl manganese antiknock are reduced by the addition to the fuel composition of from about 0.01 grams to about 10.0 grams per gallon of fuel of a lower alkyl ester of a polymerized unsaturated monomer of a carboxylic acid having from 16 to about 22 carbon atoms. The method of the invention involves operating a spark ignited internal combustion engine on a motor fuel composition containing a cyclopentadienyl manganese antiknock and the additive of the invention.

DESCRIPTION OF THE PREFERRED EMBODIMENT

Thus, one embodiment of the present invention is a lead-free or substantially lead-free hydrocarbon fuel composition for use in a spark ignited internal combustion engine which comprises a major amount of hydrocarbons boiling in the gasoline boiling range, a cyclopentadienyl manganese antiknock compound and an exhaust emission reducing amount of a polyester prepared from the reaction of a compound selected from a dimer acid, a trimer acid or a mixture of a dimer and trimer acid produced by the polymerization or condensation of an unsaturated aliphatic monocarboxylic acid having from 16 to about 22 carbon atoms per molecule and a lower alkyl aliphatic monohydric alcohol.

A more preferred embodiment of the present invention is a lead-free or substantially lead-free hydrocarbon fuel composition for use in a spark ignited internal combustion engine which comprises a major amount of hydrocarbons boiling in the gasoline boiling range, a cyclopentadienyl manganese tricarbonyl antiknock and from about 0.01 to about 10.0 grams per gallon of fuel of a polyester prepared from the reaction of a compound selected from a dimer acid, a trimer acid or a mixture of a dimer and trimer acid produced by the polymerization or condensation of an unsaturated aliphatic monocarboxylic acid having from 16 to about 22 carbon atoms per molecule and an aliphatic monohydric alcohol having from 1 to about 4 carbon atoms.

Since the invention also embodies the operation of an internal combustion engine in a manner which results in reduced exhaust hydrocarbon emissions, another embodiment of the present invention is a method of operating a spark-ignited internal combustion engine, said method comprising burning in said engine a lead-free or substantially lead-free hydrocarbon fuel composition comprising a mixture of a major amount of hydrocarbons boiling in the gasoline boiling range, a cyclopentadienyl manganese antiknock and an exhaust emission reducing amount of a polyester prepared from the reaction of a compound selected from a dimer acid, a trimer acid or a mixture of a dimer and trimer acid produced by the polymerization or condensation of an unsaturated aliphatic monocarboxylic acid having from 16 to about 22 carbon atoms per molecule and a lower alkyl aliphatic monohydric alcohol.

The base fuel in the composition of the invention comprises a mixture of liquid hydrocarbons boiling in the gasoline boiling range of from about 80° F. to about 430° F. Of course, these mixtures can contain individual constituents boiling above or below these figures. These hydrocarbon mixtures contain aromatic hydrocarbons, saturated hydrocarbons and olefinic hydrocarbons. The bulk of the hydrocarbon mixture is obtained by refining crude petroleum by either straight distillation or through the use of one of the many known refining processes, such as thermal cracking, catalytic cracking, catalytic hydroforming, catalytic reforming, and the like. Generally, the final gasoline is a blend of stocks obtained from several refinery processes. The final blend may also contain hydrocarbons made by other procedures such as alkylate made by the reaction of $C_4$ olefins and butanes using an acid catalyst such as sulfuric acid or hydrofluoric acid.

Preferred gasolines are those having a Research Octane Number of at least 85. A more preferred Research Octane Number is 90 or greater. It is also preferred to blend the gasoline such that it has a content of aromatic hydrocarbons ranging from 10 to about 60 volume percent, an olefinic hydrocarbon content ranging from 0 to about 30 volume percent, and a saturate hydrocarbon content ranging from about 40 to 80 volume percent, based on the whole gasoline.

In order to obtain fuels having properties required by modern automotive engines, a blending procedure is generally followed by selecting appropriate blending stocks and blending them in suitable proportions. The required octane level is most readily accomplished by employing aromatics (e.g. BTX, catalytic reformate or the like), alkylate (e.g., $C_{6-9}$ saturates made by reacting $C_4$ olefins with isobutane using a HF or $H_2SO_4$ catalyst), or blends of different types.

The balance of the whole fuel may be made up of other components such as other saturates, olefins, or the like. The olefins are generally formed by using such procedures as thermal cracking, catalytic cracking and polymerization. Dehydrogenation of paraffins to olefins can supplement the gaseous olefins occurring in the refinery to produce feed material for either polymerizatiion or alkylation processes. The saturated gasoline components comprise paraffins and naphthenates. These saturates are obtained from (1) virgin gasoline by distillation (straight run gasoline), (2) alkylation processes (alkylates) and (3) isomerization procedures (conversion of normal paraffins to branched chain paraffins of greater octane quality). Saturated gasoline components also occur in so-called natural gasolines. In addition to the foregoing, thermally cracked stocks, catalytically cracked stocks and catalytic reformates contain saturated components.

The classification of gasoline components into aromatics, olefins and saturates is well recognized in the art. Procedures for analyzing gasolines and gasoline components for hydrocarbon composition have long been known and used. Commonly used today is the FIA analytical method involving fluorescent indicator adsorption techniques. These are based on selective adsorption of gasoline components on an activated silica gel column; the components being concentrated by hydrocarbon type in different parts of the column. Special fluorescent dyes are added to the test sample and are also selectively separated with the sample fractions to make the boundaries of the aromatics, olefins and saturates clearly visible under ultraviolet light. Further details concerning this method can be found in "1969 Book of ASTM Standards," January 1969 Edition, under ASTM Test Designation D 1319-66T.

The motor gasolines used in formulating the improved fuels of this invention generally have initial boiling points ranging from about 80° F. to about 105° F. and final boiling points ranging from about 380° F. to about 430° F. as measured by the standard ASTM distillation procedure (ASTM D-86). Intermediate gasoline fractions boil away at temperatures within these extremes.

From the standpoint of minimizing atmospheric pollution to the greatest extent possible, it is best to keep the olefin content of the fuel as low as can be economically achieved as olefins reportedly give rise to smog-forming emissions, especially from improperly adjusted vehicular engines. Accordingly, in the preferred base stocks of this invention the olefin content will not exceed about 10 volume percent and the most particularly preferred fuels will not contain more than about 5 percent olefins. Table 1 illustrates the hydrocarbon-type makeup of a number of particularly preferred fuels which can be used in this invention.

TABLE 1

Hydrocarbon Blends of Particularly Preferred Base Fuels
Volume Percentage

| Fuel | Aromatics | Olefins | Saturates |
|---|---|---|---|
| A | 35.0 | 2.0 | 63.0 |
| B | 40.0 | 1.5 | 58.5 |
| C | 20.0 | 2.5 | 77.5 |
| D | 33.5 | 1.0 | 65.5 |
| E | 36.5 | 2.5 | 61.0 |
| F | 43.5 | 1.5 | 55.0 |
| G | 49.5 | 2.5 | 48.0 |

It is also desirable to utilize base fuels having a low sulfur content as the oxides of sulfur tend to contribute an irritating and choking character to smog and other forms of atmospheric pollution. Therefore, to the extent it is economically feasible, the fuel will contain not more than about 0.1 weight percent of sulfur in the form of conventional sulfur-containing impurities. Fuels in which the sulfur content is no more than about 0.02 weight percent are especially preferred for use in this invention.

Normally the gasoline to which this invention is applied is lead-free or substantially lead-free. The gasoline may contain antiknock quantities of other agents such as cyclopentadienyl nickel nitrosyl, N-methyl aniline, and the like. Antiknock promoters such as 2,4 pentanedione may be included. The gasoline may further contain blending agents or supplements such as methanol, isopropanol, t-butanol and the like. Antioxidants such as 2,6-di-tert-butylphenol, 2,6-di-tert-butyl-p-cresol, phenylenediamines such as N,N'-di-secbutyl-p-phenylenediamine, N-isopropylphenylenediamine, and the like, may be present. Likewise, the gasoline can contain dyes, metal deactivators, or other types of additives recognized to serve some useful purpose in improving the gasoline quality.

Cyclopentadienyl manganese tricarbonyls are known antiknocks and their preparation and use are described in U.S. Pat. Nos. 2,818,417, 2,839,552, and 3,127,351. An important antiknock of this type is methylcyclopentadienyl manganese tricarbonyl. The amount of the cyclopentadienyl manganese tricarbonyl added to the gasolines should be an amount adequate to increase its antiknock effectiveness. This has been found to be in the range of from about 0.005 to about 10 grams per gallon of manganese as a cyclopentadienyl manganese tricarbonyl. A preferred range is from about 0.05 to 6.0 grams of manganese per gallon as a cyclopentadienyl manganese tricarbonyl. A more preferred range is from about 0.05 to about 0.25 grams of manganese per gallon, and a most preferred range is from about 0.05 to about 0.125 grams of manganese per gallon as methylcyclopentadienyl manganese tricarbonyl.

The esters employed in this invention are prepared from dimer and trimer acids which are produced by the polymerization or condensation of unsaturated aliphatic monocarboxylic acids having from about 16 to about 22 carbon atoms per molecule. For example, linoleic acid can be polymerized or condensed to form essentially the dimer of linoleic acid, a dicarboxylic acid, and also can be polymerized to form essentially the trimer of linoleic acid, a tricarboxylic acid. Similarly, other $C_{16}$ to $C_{22}$ unsaturated aliphatic monocarboxylic acids, including oleic acid and ricinoleic acid, can be polymerized to dimer and trimer acids. The preparation of such dimer and trimer acids is described in U.S. Pat. No. 2,632,695.

The polyesters can be prepared by any of the well known esterification procedures described in the literature. For example, the polyesters can be prepared by reacting a suitable amount of an aliphatic alcohol with the polycarboxylic acid. Esterification is conducted according to conventional, known methods. Alcohols which are suitable for this purpose are the aliphatic alcohols, preferably, saturated aliphatic alcohols having from 1 to about 4 carbon atoms. The alcohols include methyl alcohol, ethyl alcohol, n-propyl alcohol, isopropyl alcohol, n-butyl alcohol, sec-butyl alcohol and tert-butyl alcohol. For the purposes of this invention ester and/or polyester refers to the essentially fully esterified polycarboxylic acid to distinguish from partially esterified acids having some free carboxylic acid in the ester. The dimer acid may be reacted with $C_1$ to $C_4$ aliphatic alcohol using 2 moles of the alcohol per mole of the acid. Ordinarily, the esterification is carried out in the presence of a minor amount of an acid catalyst such as sulfuric acid, phosphoric acid, p-toluenesulfonic acid, etc. The water of esterification is removed during the course of reaction. Temperatures of about 60° C. to about 200° C. for about 4 to 48 hours are typically used. The exact conditions will depend, of course, upon the esterifying alcohol. The trimer is made similarly, using 1 mole of the acid trimer and 3 moles of alcohol. When preparing the tert-butyl esters, it is desirable to use a strong dehydrating agent such as dicyclohexylcarbodiimide to aid in the removal of the water formed during the reaction.

In the usual case, when preparing dimers and trimers, it is difficult, as a practical matter, to avoid the formation of both the dimers and trimers. Thus, the dimerization-trimerization process results in the formation of mixtures of both dimers and trimers. Normally, these mixtures of the dimer and trimer will be composed of from about 10°/o to about 90°/o by weight of the dimer to from about 90°/o to about 10°/o by weight of the trimer. There may also be formed a tetrameric form by further polymerization, and some unreacted monomer is usually present. However, by adjusting conditions, such a process can be carried out so as to favor the formation of one or the other acid. For example, under milder conditions, the formation of dimer acid will be favored, in which case the product also usually will contain some unreacted unsaturated acid. Under more rigorous conditions, for example, at higher temperatures and/or heating times, the formation of trimer acid will be favored and essentially 100°/o conversion of starting unsaturated acid can be achieved. In general, however, the additive esters of the present invention are prepared from mixtures of the acid dimers and trimers. The preferred dimer-trimer acids are derived from oleic and linoleic acids, which produce a dimer of 32 carbons and a trimer of 54 carbons. Thus, the preferred exhaust emission reducing additives for use in the fuel compositions of the present invention are the $C_1$ to $C_4$ alkyl esters of the dimer and/or trimer acids derived from oleic and linoleic acids. Especially preferred polyester additives are the dimethyl, di-isopropyl and di-t-butyl dimerates and trimerates of oleic and linoleic acids.

Both the polyester additives of the present invention, as well as the dimers and trimers of the unsaturated aliphatic monocarboxylic acids from which the ester additives of the present invention are prepared are, for the most part, available commercially.

The novel fuel compositions of the present invention are prepared simply by adding the cyclopentadienyl manganese antiknock compound and the polyester additive of the present invention to the base fuel with sufficient agitation to give a uniform blend of motor fuel. Broadly, the polyester additive can be employed in a range of from about 0.01 gram of additive to about 10.0 grams of additive per gallon of fuel. It is to be understood that concentrations somewhat outside this range can be used if desired. A particularly preferred concentration of additive compound is from about 0.25 to about 5.0 grams of additive compound per gallon of fuel. An even more preferred concentration of additive compound is from about 0.5 gram to about 1.0 gram of additive per gallon of fuel. There is no real upper limit on the amount of polyester additive that can be added to the motor fuel compositions of the present invention other than perhaps a maximum limitation dictated by economic considerations. In general, however, one uses an additive quantity having adequate exhaust emission reducing properties.

Having described the invention in general terms, the following are offered to specifically illustrate the invention. It is to be understood they are illustrations only and that the invention shall not be limited except as limited by the appended claims.

EXAMPLE 1

This example illustrates the exhaust emission reducing properties of the compounds of this invention.

Dynamometer tests were conducted to demonstrate the useful exhaust emission reducing properties of the present compounds. In these tests, a 4-cylinder engine having an 8.3:1 compression ratio and a 151 cubic inch (2.5 liter) displacement equipped with a production 2-barrel carburetor, EGR and an EFE intake manifold was operated on an unleaded gasoline containing 0.0625 gram of manganese as methylcyclopentadienyl manganese tricarbonyl. The engine was idled for 45 seconds and then run at 50% wide open throttle for 145 seconds under the following conditions.

TABLE 2

| | Idle | Cruise (50 MPH Road-Load) |
|---|---|---|
| Time | 45 sec. | 135 sec. |
| Speed | 1000 RPM | 2250 RPM |
| Load | None | 35 ft-lb |
| Man. Vac. | 20 in. Hg | 13 in. Hg |
| A/F Ratio | Stoichiometric | 16.0 |

The above cycle was continuously repeated until the hydrocarbon emissions had stabilized. This usually required about 140–145 hours of operation. The hydrocarbon content of the exhaust gas was determined using a Beckman 400 Flame Isomerization Detector. The procedure was first carried out using a fuel without the emission reducing additive to obtain a baseline exhaust emission increase and then repeated on the same fuel containing an emission reducing additive. This was followed by another test on the fuel, again without the emission additive, to reconfirm the baseline. After about each 24 hours of test time, hydrocarbon emission measurements were taken at 50% wide open throttle after which the engine was returned to the cycling schedule. At the end of approximately 140 hours of testing, hydrocarbon emission measurements were taken at 50% wide open throttle and the engine was returned to the cycling schedule for a 1–2 hour period and then shut down. Using this procedure, the percent reduction in exhaust hydrocarbon emission increase was obtained using the emission reducing additives of this invention.

The base fuel employed in these tests contained 0.0625 gram of manganese per gallon of fuel as methylcyclopentadienyl manganese tricarbonyl and consisted of 22.5% aromatics, 8.0% olefins and 69.5% aliphatic hydrocarbons. The fuel had an ASTM distillation, I.B.P. of 89° F., an E.P. of 394° F.; a Research Octane No. of 92.77 and a Motor Octane No. of 83.43.

The following table lists the polyester additives tested in accordance with the above method.

TABLE 3

| Additive: | |
|---|---|
| A Dimethyl | Esters of the Dimers and Trimers of Oleic Acid |
| B Di-isopropyl | Esters of the Dimers and Trimers of Oleic Acid |
| C Di-t-butyl | Esters of the Dimers and Trimers of Linoleic Acid |

Additive A, obtained commercially from Emery Industries, Inc., 1300 Carew Tower, Cinncinnati, Ohio 45202, was stated to be prepared from an Emery product sold as Empol 1016. Empol 1016 is a polymerized fatty acid stated to be $C_{36}$ dibasic acid resulting from the polymerization of dimerization of $C_{18}$ unsaturated fatty acids. It is a liquid stated to have the following typical characteristics: Dimer content 87%; Trimer content 13%; Monobasic acids, 1.0% max.; Acid value 190–198; Saponification value, 194–200; Color, 1963 Gardner, max. 6; Unsaponifiables, 0.5% max,; Refractive index, 25° C.-1.479; Specific gravity, 25/20° C.-0.961; Specific gravity, 100/20° C.-0.904; Density, lbs/gal., 25° C.-8.0; Pour point, 35° F.; flash point (COC), 530° F.; Viscosity, Gardner-Holt, 25° C., Z-3; Viscosity, cSt. at 210° F.-75; 100° F.-1800; 25° C.-5300; Surface tension, dynes/cm, 2520 C.-31.9. The ester additive prepared from Empol 1016, was stated to have the following characteristics:

| | |
|---|---|
| Acid Value | 3.8 |
| Hydroxyl Value | 3.8 |
| Viscosity at 210° F., cs | 8.8 |
| Viscosity at 100° F., cs | 57.1 |
| Cloud Point, °F. | −10 |
| Pour Point, °F. | −10 |
| Flash Point, °F. | 545 |
| Fire Point, °F. | 610 |
| Viscosity Index | 142 |
| Moisture, ppm | 147 |

Additive B was also obtained commercially from Emery Industries, Inc. It too was reported to be derived from Emery product Empol 1016.

Additive C, the di-tert-butyl ester derived from linoleic acid, was prepared by reacting tert-butyl alcohol with the dimer of linoleic acid (commercially sold by and obtained from the Union Camp Corporation, P.O. Box 6170, Jacksonville, Florida 33205 and designated Century D-77) in the presence of dicyclohexylcarbodiimide: The Union Camp product was stated to contain 56% of the Dimer, 24% of the Trimer (or higher) and 20% of the Monomer acid. The ester was prepared according to the following procedure:

A 2 liter, 4-neck flask was fitted with a pressure equalized dropping funnel, thermometer, stirrer and condenser all under nitrogen. Into the flask were placed 354.4 grams (0.5; 1 equivalent of acid) of dimer acid (Union Camp Century D-77; acid no., 158.3), 628.0 grams of methylene chloride, 296.0 grams (4.0 moles) of tert-butyl alcohol and 5.0 grams of 4-dimethylaminopyridine. To this mixture was added 108.2 grams (0.525 mole) of dicyclohexylcarbodiimide over a 9 minute period while holding the temperature between 22°–25° C. The mixture was held at 25° C. for 4 hours and then filtered to remove dicyclohexylurea. The solvent and excess alcohol were removed on the rotary evaporator under vacuum. The residue was dissolved in 400 ml. n-heptane and filtered again to remove the last of the dicyclohexylurea. The product solution was then washed with 200 ml. 0.5 N hydrochloric acid, 200 ml. water, 300 ml. saturated sodium bicarbonate solution and finally with 2×200 ml. water. The solution was dried over magnesium sulfate, filtered and stripped under vacuum to give 288.3 grams of dark material. Analysis: Acid No., 44.9; IR and NMR showed approximately 30 mole % acid left.

The above product, weighing 267.3 grams (0.21 mole carbonyl based on acid no.), 74.0 grams (1.0 mole) of tert-butyl alcohol, 634.2 grams of methylene chloride and 2.5 grams of 4-dimethylaminopyridine were placed in the 2 liter 4-neck flask as previously described. To this mixture was added 64.8 grams (0.22 mole) of dicyclohexylcarbodiimide. The mixture was held at 25° C. for 3.75 hours and was then treated as described above. The product was a clear, dark brown viscous liquid, weighing 253.2 grams. Analysis: Acid No. 19.2.

The concentration of exhaust emission reducing additives in each of the fuels tested was in each case 1.0 gram of additive per gallon of fuel. Test fuels were prepared by simply adding a sufficient amount of additive to the base fuel, described above, containing 0.0625 gram of manganese as methylcyclopentadienyl manganese tricarbonyl to provide a fuel composition having 1.0 grams of additive per gallon of fuel.

The following results were obtained in the aforedescribed tests with and without the indicated amounts of additives listed in Table 3 above.

TABLE 4

| Additive | Hydrocarbon p.p.m.[1] | Reduction of Emission Increase % |
|---|---|---|
| None | 320 | |
| Additive A | 251 | 55[2] |
| | 259 | |
| Additive B | 285 | 10 |
| Additive C | 225 | 85 |

[1]End of test minus start of test results
[2]Average from 2 separate tests

As these results show, the emission reducing additives of the present invention effectively reduce exhaust emission increases in gasoline containing cyclopentadienyl manganese antiknocks.

It has also been discovered in accordance with the present invention that mixtures of polycarboxylic dimer and trimer acids produced by the polymerization or condensation of an unsaturated aliphatic monocarboxylic acid having from 16 to about 22 carbon atoms per molecule together with their corresponding lower alkyl esters hereinabove described also provide hydrocarbon exhaust emission reducing properties when added to a lead-free or substantially lead-free gasoline fuel composition.

The ratio of acid to ester in the additive mixture can be from about 10% to about 90% by weight of the acid to about 90% to about 10% by weight of the ester. It is to be understood, however, that ratios outside this range can be used if desired. Especially preferred is a mixture of equal parts of acid and ester. The total amount of combined acid-ester additive added to the base fuel composition should be an amount sufficient to provide from about 0.01 to about 10.0 grams of additive mixture per gallon of fuel. Although there is no real upper limit on the concentration of the hydrocarbon emission reducing acid ester additive mixture that can be used in the gasoline compositions of the present invention, one generally uses an additive quantity having adequate exhaust emission reducing properties. Thus, another embodiment of the present invention is a lead-free or substantially lead-free hydrocarbon fuel composition for use in a spark ignited internal combustion engine which comprises a major amount of hydrocarbons boiling in the gasoline boiling range, a cyclopentadienyl manganese antiknock compound and from about 0.01 to about 10.0 grams of an exhaust emission reducing mixture comprising from about 10% to about 90% by weight of a compound selected from (1) a polycarboxylic dimer acid, a polycarboxylic trimer acid or a mixture of a polycarboxylic dimer and trimer acid produced by the polymerization or condensation of an unsaturated aliphatic monocarboxylic acid having from 16 to about 22 carbon atoms per molecule, and (2) from about 90% to about 10% by weight of a compound selected from the corresponding lower alkyl polyesters of said polycarboxylic dimer and trimer acids prepared by reacting said polycarboxylic dimer and trimer acids with a lower alkyl aliphatic monohydric alcohol having from 1 to about 4 carbon atoms.

EXAMPLE 2

This example illustrates the hydrocarbon exhaust emission reducing properties of an additive agent comprising equal parts of (1) the polyester identified and described in Example 1 above as Additive A, and (2) an Emery product sold as Empol 1003, described as a polymerized fatty acid stated to be $C_{36}$ dibasic acid derived from tall oil and having a dimer content at 67%, a trimer content of 19% and a monomer content of 14%. The additive mixture was added to a base fuel of the same composition set forth and described in Example 1 above in an amount sufficient to provide 1 gram per gallon of the composite additive agent per gallon of fuel. The resultant fuel composition was then tested in the dynamometer engine test according to the procedure set forth in Example 1. At the end of approximately 140 hours of engine operation, there was a reduction in emission increase of 85% with the fuel containing the composite exhaust emission reducing additive.

Thus, additive mixtures of polycarboxylic dimer and trimer acids containing an average of from 32 to 66 carbon atoms and their corresponding lower alkyl esters are also effective for reducing exhaust hydrocarbon emissions when added to organomanganese antiknock containing gasoline compositions.

The polyester additives of this invention can be added directly to gasoline as aforedescribed or they can be added in the form of a concentrate. Thus, another embodiment of the invention is a hydrocarbon exhaust emission reducing additive fluid concentrate for use in lead-free or substantially lead-free gasoline which comprises an organomanganese antiknock compound in an amount sufficient to improve the antiknock characteristics of the gasoline, and an exhaust emission reducing amount of a polyester prepared from the reaction of a compound selected from a polycarboxylic dimer acid, a polycarboxylic trimer acid or a mixture of a polycarboxylic dimer and trimer acid produced by the polymerization or condensation of an unsaturated aliphatic monocarboxylic acid having from 16 to about 22 carbon atoms per molecule and a lower alkyl monohydric alcohol having from 1 to about 4 carbon atoms.

Alternatively, the hydrocarbon exhaust emission reducing component of the additive fluid concentrate may be composed of a mixture of polycarboxylic dimer and/or trimer acids produced by the polymerization or condensation of an unsaturated aliphatic monocarboxylic acid having from 16 to about 22 carbon atoms per molecule and the corresponding lower alkyl polyesters of said polycarboxylic dimer and/or trimer acids prepared by reacting said polycarboxylic dimer and trimer acids with a lower alkyl monohydric alcohol having from 1 to about 4 carbon atoms. Thus, a still further embodiment of the present invention is a hydrocarbon exhaust emission reducing additive fluid concentrate for use in a lead-free or substantially lead-free gasoline which comprises an organomanganese antiknock compound, preferably a cyclopentadienyl manganese antiknock compound in an amount sufficient to improve the antiknock characteristics of the gasoline, and an exhaust emission reducing amount of an additive agent comprising a mixture of (1) a polycarboxylic dimer acid, a polycarboxylic trimer acid or a mixture of a polycarboxylic dimer and trimer acid produced by the polymerization or condensation of an unsaturated aliphatic monocarboxylic acid having from 16 to about 22 carbon atoms per molecule, and (2) the corresponding lower alkyl polyesters of said polycarboxylic dimer and trimer acids prepared by reacting said polycarboxylic dimer and trimer acids with a lower alkyl aliphatic monohydric alcohol having from 1 to about 4 carbon atoms.

The weight ratio of exhaust emission reducing agent to manganese in these additive concentrates can vary from about 200 parts hydrocarbon exhaust emission reducing agent to about 1 part by weight manganese and from about 1 part by weight hydrocarbon exhaust emission reducing agent to about 100 parts by weight manganese. A preferred weight ratio is from about 20 parts by weight exhaust emission reducing agent to about 1 part by weight manganese and from about 12 parts exhaust emission reducing agent to about 1 part manganese. Especially preferred additive concentrates comprise equal parts of exhaust emission reducing agents and manganese. A preferred cyclopentadienyl manganese antiknock concentrate component is methylcyclopentadienyl manganese tricarbonyl.

The amount of additive concentrate added to a lead-free or substantially lead-free gasoline is an amount sufficient to provide from about 0.01 to about 10 grams of exhaust emission reducing agent per gallon of gasoline and from about 0.005 to about 10 grams of manganese, preferably as methylcyclopentadienyl manganese tricarbonyl, per gallon of gasoline.

The concentrates of this invention are readily prepared by merely blending the organomanganese antiknock compound and exhaust emission reducing additive together until a homogenous solution having the desired weight ratio of exhaust emission reducing agent to manganese is obtained. The concentrates may optionally contain other additives normally used with gasoline such as dyes, stabilizers, anti-oxidants, anti-rust agents, detergents, solvents, etc. The concentrate serves to facilitate the addition of a number of additives to the fuel in only one step.

The following examples illustrate the preparation of some typical concentrates.

EXAMPLE 3

To a blending vessel is added 200 parts of the emission reducing polyester identified and described in Example 1 above as Additive A and 1 part manganese as methylcyclopentadienyl manganese tricarbonyl. The mixture is stirred until homogenous, forming an additive concentrate useful for improving the exhaust emission reducing properties of a lead-free or substantially lead-free gasoline.

EXAMPLE 4

To a blending vessel is added 20 parts of emission reducing polyester identified and described in Example 1 above as Additive C and 1 part manganese as methylcyclopentadienyl manganese tricarbonyl. The mixture is stirred until homogenous, forming an additive concentrate useful for improving the exhaust emission reducing properties of a lead-free or substantially lead-free gasoline.

I claim:

1. A lead-free or substantially lead-free hydrocarbon fuel composition for use in a spark ignited internal combustion engine which comprises a major amount of hydrocarbons boiling in the gasoline boiling range, a cyclopentadienyl manganese antiknock compound and an exhaust emission reducing amount of a polyester prepared from the reaction of a compound selected from a dimer acid, a trimer acid or a mixture of a dimer and trimer acid produced by the polymerization or condensation of an unsaturated aliphatic monocarboxylic acid having from 16 to about 22 carbon atoms per molecule and a lower alkyl aliphatic monohydric alcohol.

2. A lead-free or substantially lead-free hydrocarbon fuel composition for use in a spark ignited internal combustion engine which comprises a major amount of hydrocarbons boiling in the gasoline boiling range, a cyclopentadienyl manganese antiknock compound and an exhaust emission reducing amount of a polyester prepared from the reaction of a compound selected from a dimer acid, a trimer acid or a mixture of a dimer and trimer acid produced by the polymerization or condensation of an unsaturated aliphatic monocarboxylic acid having from 16 to about 22 carbon atoms per molecule and an aliphatic monohydric alcohol having from 1 to about 4 carbon atoms.

3. The composition of claim 2 containing from about 0.01 to about 10.0 grams of said polyester per gallon of fuel.

4. The composition of claim 3 wherein said polyester is the polyester of the reaction of the dicarboxylic acid dimer of oleic acid and an aliphatic alcohol having from 1 to 4 carbon atoms.

5. The composition of claim 4 wherein said polyester is the dimethyl ester of the dimer of oleic acid.

6. The composition of claim 4 wherein said polyester is the di-isopropyl ester of the dimer of oleic acid.

7. The composition of claim 4 wherein said polyester is the di-tertiary butyl ester of the dimer of oleic acid.

8. The composition of claim 3 wherein said polyester is the polyester of the reaction of the tricarboxylic acid trimer of oleic acid and an aliphatic alcohol having from 1 to 4 carbon atoms.

9. The composition of claim 8 wherein said polyester is the dimethyl ester of the trimer of oleic acid.

10. The composition of claim 8 wherein said polyester is the trimethyl ester of the trimer of oleic acid.

11. The composition of claim 8 wherein said polyester is the di-isopropyl ester of the trimer of oleic acid.

12. The composition of claim 8 wherein said polyester is the tri-isopropyl ester of the trimer of oleic acid.

13. The composition of claim 8 wherein said polyester is the di-tertiary butyl ester of the trimer of oleic acid.

14. The composition of claim 8 wherein said polyester is the tri-tertiary butyl ester of the trimer of oleic acid.

15. The composition of claim 3 wherein said polyester comprises a mixture of the $C_1$–$C_4$ alcohol diesters of the dimer of oleic acid and the $C_1$–$C_4$ alcohol triesters of the trimer of oleic acid.

16. The composition of claim 3 wherein said polyester is the polyester of the reaction of the dicarboxylic acid dimer of linoleic acid and an aliphatic alcohol having from 1 to 4 carbon atoms.

17. The composition of claim 16 wherein said polyester is the dimethyl ester of the dimer of linoleic acid.

18. The composition of claim 16 wherein said polyester is the di-isopropyl ester of the dimer of linoleic acid.

19. The composition of claim 16 wherein said polyester is the di-tertiary butyl ester of the dimer of linoleic acid.

20. The composition of claim 3 wherein said polyester is the polyester of the reaction of the tricarboxylic acid trimer of linoleic acid and an aliphatic alcohol having from 1 to 4 carbon atoms.

21. The composition of claim 20 wherein said polyester is the dimethyl ester of the trimer of linoleic acid.

22. The composition of claim 20 wherein said polyester is the trimethyl ester of the trimer of linoleic acid.

23. The composition of claim 20 wherein said polyester is the di-isopropyl ester of the trimer of linoleic acid.

24. The composition of claim 20 wherein said polyester is the tri-isopropyl ester of the trimer of linoleic acid.

25. The composition of claim 20 wherein said polyester is the di-tertiary butyl ester of the trimer of linoleic acid.

26. The composition of claim 20 wherein said polyester is the tri-tertiary butyl ester of the trimer of linoleic acid.

27. The composition of claim 3 wherein said polyester comprises a mixture of the $C_1$–$C_4$ alcohol diesters of the dimer of linoleic acid and the $C_1$–$C_4$ alcohol triesters of the trimer of linoleic acid.

28. The composition of claim 2 wherein said cyclopentadienyl manganese antiknock compound is a cyclopentadienyl manganese tricarbonyl.

29. The composition of claim 28 wherein said cyclopentadienyl group is a hydrocarbon group containing 5 to 17 carbon atoms.

30. The composition of claim 29 wherein said cyclopentadienyl group is methylcyclopentadienyl.

31. The composition of claim 30 containing from about 0.005 to about 10.0 grams of manganese per gallon of gasoline as methylcyclopentadienyl manganese tricarbonyl.

32. The composition of claim 31 containing from about 0.01 to about 10.0 grams of said polyester per gallon of fuel.

33. The composition of claim 32 wherein said polyester is the polyester of the reaction of the dicarboxylic acid dimer of oleic acid and an aliphatic alcohol having from 1 to 4 carbon atoms.

34. The composition of claim 33 wherein said polyester is the dimethyl ester of the dimer of oleic acid.

35. The composition of claim 33 wherein said polyester is the di-isopropyl ester of the dimer of oleic acid.

36. The composition of claim 33 wherein said polyester is di-tertiary butyl ester of the dimer of oleic acid.

37. The composition of claim 32 wherein said polyester is the polyester of the reaction of the tricarboxylic acid trimer of oleic acid and an aliphatic alcohol having from 1 to 4 carbon atoms.

38. The composition of claim 27 wherein said polyester is the dimethyl ester of the trimer of oleic acid.

39. The composition of claim 37 wherein said polyester is the trimethyl ester of the timer of oleic acid.

40. The composition of claim 37 wherein said polyester is the di-isopropyl ester of the trimer of oleic acid.

41. The composition of claim 37 wherein said polyester is the tri-isopropyl ester of the trimer of oleic acid.

42. The composition of claim 37 wherein said polyester is a di-tertiary butyl ester of the trimer of oleic acid.

43. The composition of claim 37 wherein said polyester is the tri-tertiary butyl ester of the trimer of oleic acid.

44. The composition of claim 32 wherein said polyester comprises a mixture of the $C_1$–$C_4$ alcohol diesters of the dimer of oleic acid and the $C_1$–$C_4$ alcohol triesters of the trimer of oleic acid.

45. The composition of claim 32 wherein said polyester is the polyester of the reaction of the dicarboxylic acid dimer of linoleic acid and an aliphatic alcohol having from 1 to 4 carbon atoms.

46. The composition of claim 45 wherein said polyesters is the dimethyl ester of the dimer of linoleic acid.

47. The composition of claim 45 wherein said polyester is the di-isopropyl ester of the dimer of linoleic acid.

48. The composition of claim 45 wherein said polyester is the di-tertiary butyl ester of the dimer of linoleic acid.

49. The composition of claim 32 wherein said polyester is the reaction of the tricarboxylic acid trimer of linoleic acid and an aliphatic alcohol having from 1 to 4 carbon atoms.

50. The composition of claim 49 wherein said polyester is the dimethyl ester of the trimer of linoleic acid.

51. The composition of claim 49 wherein said polyester is the trimethyl ester of the trimer of linoleic acid.

52. The composition of claim 49 wherein said polyester is the di-isopropyl ester of the trimer of linoleic acid.

53. The composition of claim 49 wherein said polyester is the tri-isopropyl ester of the trimer of linoleic acid.

54. The composition of claim 49 wherein said polyester is the di-tertiary butyl ester of the trimer of linoleic acid.

55. The composition of claim 49 wherein said polyester is the tri-tertiary butyl ester of the trimer of linoleic acid.

56. The composition of claim 32 wherein said polyester comprises a mixture of the $C_1$–$C_4$ alcohol diesters of the dimer of linoleic acid and the $C_1$–$C_4$ alcohol triesters of the trimer of linoleic acid.

57. A method of operating a spark ignited internal combustion engine, said method comprising burning in said engine a lead-free or substantially lead-free hydrocarbon fuel composition comprising a mixture of a major amount of hydrocarbons boiling in the gasoline boiling range, a cyclopentadienyl manganese antiknock compound and an exhaust emission reducing amount of a polyester prepared from the reaction of a compound selected from a dimer acid, a trimer acid or a mixture of a dimer and a trimer acid produced by the polymerization or condensation of an unsaturated aliphatic monocarboxylic acid having from 16 to about 22 carbon atoms per molecule and a lower alkyl aliphatic monohydric alcohol.

58. A method of operating a spark ignited internal combustion engine, said method comprising burning in said engine a lead-free or substantially lead-free hydrocarbon fuel composition comprising a mixture of a major amount of hydrocarbons boiling in the gasoline boiling range, a cyclopentadienyl manganese antiknock compound and an exhaust emission reducing amount of a polyester prepared from the reaction of a compound selected from a dimer acid, a trimer acid or a mixture of a dimer and a trimer acid produced by the polymerization or condensation of an unsaturated aliphatic monocarboxylic acid having from 16 to about 22 carbon atoms per molecule and an aliphatic monohydric alcohol having from 1 to 4 carbon atoms.

59. The method of claim 58 wherein said fuel composition contains from about 0.01 to about 10.0 grams of said polyester per gallon of fuel.

60. The method of claim 59 wherein said polyester is the polyester of the reaction of the dicarboxylic acid dimer of oleic acid and an aliphatic alcohol having from 1 to 4 carbon atoms.

61. The method of claim 59 wherein said polyester is the polyester of the reaction of the tricarboxylic acid trimer of oleic acid and an aliphatic alcohol having from 1 to 4 carbon atoms.

62. The method of claim 59 wherein said polyester comprises a mixture of the $C_1$–$C_4$ alcohol diesters of the dimer of oleic acid and the $C_1$–$C_4$ alcohol triesters of the trimer of oleic acid.

63. The method of claim 59 wherein said polyester is the polyester of the reaction of the dicarboxylic acid dimer of linoleic acid and an aliphatic alcohol having from 1 to 4 carbon atoms.

64. The method of claim 59 wherein said polyester is the polyester of the reaction of the tricarboxylic acid trimer of linoleic acid and an aliphatic alcohol having from 1 to 4 carbon atoms.

65. The method of claim 59 wherein said polyester comprises a mixture of the $C_1$–$C_4$ alcohol diesters of the dimer of linoleic acid and the $C_1$–$C_4$ alcohol triesters of the trimer of linoleic acid.

66. The method of claim 59 wherein said cyclopentadienyl manganese compound is a cyclopentadienyl manganese tricarbonyl.

67. The method of claim 66 wherein said cyclopentadienyl group is a hydrocarbon group containing 5 to 17 carbon atoms.

68. The method of claim 67 wherein said cyclopentadienyl group is methylcyclopentadienyl.

69. The method of claim 68 containing from about 0.005 to about 10.0 grams of manganese per gallon of gasoline as methylcyclopentadienyl manganese tricarbonyl.

70. The method of claim 69 wherein said polyester is the polyester of the reaction of the dicarboxylic acid dimer of oleic acid and an aliphatic alcohol having from 1 to 4 carbon atoms.

71. The method of claim 69 wherein said polyester is the polyester of the reaction of the tricarboxylic acid trimer of oleic acid and an aliphatic alcohol having from 1 to 4 carbon atoms.

72. The method of claim 69 wherein said polyester comprises a mixture of the $C_1$–$C_4$ alcohol diesters of the dimer of oleic acid and the $C_1$–$C_4$ alcohol triesters of the trimer of oleic acid.

73. The method of claim 69 wherein said polyester is the polyester of the reaction of the dicarboxylic acid dimer of linoleic acid and an aliphatic alcohol having from 1 to 4 carbon atoms.

74. The method of claim 69 wherein said polyester is the polyester of the reaction of the tricarboxylic acid trimer of linoleic acid and an aliphatic alcohol having from 1 to 4 carbon atoms.

75. The method of claim 69 wherein said polyester comprises a mixture of the $C_1$–$C_4$ alcohol diesters of the dimer of linoleic acid and the $C_1$–$C_4$ alcohol triesters of the trimer of linoleic acid.

76. A lead-free or substantially lead-free hydrocarbon fuel composition for use in a spark ignited internal combustion engine which comprises a major amount of hydrocarbons boiling in the gasoline boiling range, a cyclopentadienyl manganese antiknock compound and from about 0.01 to about 10.0 grams of an exhaust emission reducing mixture comprising from about 10% to about 90% by weight of a compound selected from (1) a polycarboxylic dimer acid, a polycarboxylic trimer acid or a mixture of a polycarboxylic dimer and trimer acid produced by the polymerization or condensation of an unsaturated aliphatic monocarboxylic acid having from 16 to about 22 carbon atoms per molecule, and (2) from about 90% to about 10% by weight of a compound selected from the corresponding lower alkyl polyesters of said polycarboxylic dimer and trimer acids prepared by reacting said polycarboxylic dimer and trimer acids with a lower alkyl aliphatic monohydric alcohol having from 1 to about 4 carbon atoms.

77. The composition of claim 76 wherein said unsaturated aliphatic monocarboxylic acid is oleic acid and said polyesters are the $C_1$–$C_4$ alcohol esters of the dimers and trimers of oleic acid.

78. The composition of claim 77 wherein said cyclopentadienyl manganese antiknock compound is a cyclopentadienyl manganese tricarbonyl.

79. The composition of claim 78 wherein said cyclopentadienyl group is a hydrocarbon group containing 5 to 17 carbon atoms.

80. The composition of claim 79 wherein said cyclopentadienyl group is methylcyclopentadienyl.

81. The composition of claim 80 containing the 0.005 to about 10.0 grams of manganese per gallon of fuel as methylcyclopentadienyl manganese tricarbonyl.

82. The composition of claim 76 wherein said unsaturated aliphatic monocarboxylic acid is linoleic acid and said polyesters are the $C_1$–$C_4$ alcohol esters of the dimers and trimers of linoleic acid.

83. The composition of claim 82 wherein said cyclopentadienyl manganese antiknock compound is cyclopentadienyl manganese tricarbonyl.

84. The composition of claim 83 wherein said cyclopentadienyl group is a hydrocarbon group containing 5 to 17 carbon atoms.

85. The composition of claim 84 wherein said cyclopentadienyl group is methyl cyclopentadienyl.

86. The composition of claim 85 containing from 0.005 to about 10.0 grams of manganese per gallon of fuel as methylcyclopentadienyl manganese tricarbonyl.

87. A hydrocarbon exhaust emission reducing additive fluid concentrate for use in lead-free or substantially lead-free gasoline which comprises a cyclopentadienyl manganese antiknock compound in an amount sufficient to improve the antiknock characteristics of said gasoline and an exhaust emission reducing amount of a polyester prepared from the reaction of a compound selected from a polycarboxylic dimer acid, a polycarboxylic trimer acid or a mixture of a polycarboxylic dimer and trimer acid produced by the polymerization or condensation of an unsaturated aliphatic monocarboxylic acid having from 16 to about 22 carbon atoms per molecule and a lower alkyl monohydric alcohol having from 1 to about 4 carbon atoms.

88. The additive fluid concentrate of claim 87 comprising from about 200 parts by weight polyester to about 1 part by weight manganese as methylcyclopentadienyl manganese tricarbonyl and from about 1 part by weight polyester to about 100 parts by weight manganese as methylcyclopentadienyl manganese tricarbonyl.

89. The additive fluid concentration of claim 88 sufficient to provide from about 0.005 to about 10.0 grams of manganese per gallon of gasoline as methylcyclopentadienyl manganese tricarbonyl and from about 0.01 to about 10.0 grams of said polyester per gallon of fuel.

90. A hydrocarbon exhaust emission reducing additive fluid concentrate for use in a lead-free or substantially lead-free gasoline which comprises a cyclopentadienyl manganese antiknock compound in an amount sufficient to improve the antiknock characteristics of said gasoline and an exhaust emission reducing amount of an additive agent comprising a mixture of (1) a polycarboxylic dimer acid, a polycarboxylic trimer acid or a mixture of a polycarboxylic dimer and trimer acid produced by the polymerization or condensation of an unsaturated aliphatic monocarboxylic acid having from about 16 to about 22 carbon atoms per molecule, and (2) the corresponding lower alkyl polyesters of said polycarboxylic dimer and trimer acids prepared by reacting said polycarboxylic dimer and trimer acids with a lower alkyl aliphatic monohydric alcohol having from 1 to about 4 carbon atoms.

91. The additive fluid concentrate of claim 90 comprising from about 200 parts by weight hydrocarbon exhaust emission reducing agent to about 1 part by weight manganese as methylcyclopentadienyl manganese tricarbonyl and from 1 part by weight hydrocarbon exhaust emission reducing agent to about 100 parts by weight manganese as methylcyclopentadienyl manganese tricarbonyl.

92. The additive fluid concentrate of claim 91 sufficient to provide from about 0.005 to about 10.0 grams of manganese as methylcyclopentadienyl manganese tricarbonyl per gallon of gasoline and from about 0.1 to about 10.0 grams of exhaust emission reducing agent per gallon of gasoline.

* * * * *